US009279314B2

(12) United States Patent
Hoteit

(10) Patent No.: US 9,279,314 B2
(45) Date of Patent: Mar. 8, 2016

(54) HEAT FRONT CAPTURE IN THERMAL RECOVERY SIMULATIONS OF HYDROCARBON RESERVOIRS

(75) Inventor: Hussein Ali Hoteit, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 46 days.

(21) Appl. No.: 13/207,976

(22) Filed: Aug. 11, 2011

(65) Prior Publication Data

US 2013/0041633 A1 Feb. 14, 2013

(51) Int. Cl.
*G06F 17/10* (2006.01)
*E21B 43/00* (2006.01)

(52) U.S. Cl.
CPC ..... *E21B 43/00* (2013.01)

(58) Field of Classification Search
CPC ..... E21B 43/00; E21B 49/00; E21B 43/164; E21B 43/166; G01V 1/301; G01V 11/00; G06F 17/5018; G06F 17/5004; G06F 17/12; G06F 17/5009; G06T 17/05; G06T 17/20
USPC ..... 703/1, 2, 5, 10; 702/6–16
See application file for complete search history.

(56) References Cited

U.S. PATENT DOCUMENTS

| | | | |
|---|---|---|---|
| 6,152,226 | A | 11/2000 | Talwani et al. |
| 6,718,291 | B1 | 4/2004 | Shapiro et al. |
| 6,823,297 | B2 | 11/2004 | Jenny et al. |

(Continued)

FOREIGN PATENT DOCUMENTS

| | | |
|---|---|---|
| WO | 0102832 | 1/2001 |
| WO | 2007061618 | 5/2007 |
| WO | 2008006851 | 1/2008 |

OTHER PUBLICATIONS

Hoteit et al. ("Compositional Modeling by the Combined Discontinuous Galerkin and Mixed Methods", SPE Journal Mar. 2006, pp. 19-34).*

(Continued)

*Primary Examiner* — Omar Fernandez Rivas
*Assistant Examiner* — Iftekhar Khan
(74) *Attorney, Agent, or Firm* — ConocoPhillips Company

(57) ABSTRACT

A numerical procedure is disclosed to improve the prediction of heat fronts when simulating hot fluid injection in viscous hydrocarbon reservoirs. The mathematical model is composed of the conventional governing equations that describe multiphase fluid flow and energy balance. The reservoir geometry can be partitioned into a regular Cartesian grid or an irregular corner-point geometry grid. The numerical procedure uses the finite different (FD) method to solve the flow equations and the discontinuous Galerkin (DG) method to solve the energy balance equation. The proposed FD-DG method is an alternative to the traditional solution procedure that uses the FD method to solve both the flow and the energy equations. The traditional method has the deficiency that it may require excessive number of grid cells to achieve acceptable resolution of the heat fronts. The proposed FD-DG method significantly reduces numerical dispersion near discontinuities in the solution of the energy equation and therefore provides a better capture of the heat fronts. To obtain a desired accuracy in the energy equation solution, the FD-DG method can be orders of magnitude faster than the traditional method. The superiority of the FD-DG method is that it converges on coarser grids while the traditional method requires much finer grids.

14 Claims, 10 Drawing Sheets

(56) References Cited

U.S. PATENT DOCUMENTS

| | | | | |
|---|---|---|---|---|
| 6,842,725 | B1 | 1/2005 | Sarda | |
| 6,922,662 | B2 | 7/2005 | Manceau et al. | |
| 7,006,959 | B1 | 2/2006 | Huh et al. | |
| 7,024,342 | B1 | 4/2006 | Waite et al. | |
| 7,027,964 | B2 | 4/2006 | Kennon | |
| 7,164,990 | B2 * | 1/2007 | Bratvedt et al. | 702/12 |
| 7,249,009 | B2 | 7/2007 | Ferworn et al. | |
| 2008/0006851 | A1 | 1/2008 | Moriya et al. | |
| 2008/0208539 | A1 * | 8/2008 | Lee et al. | 703/1 |
| 2013/0346035 | A1 * | 12/2013 | Madasu et al. | E21B 47/10 703/2 |

OTHER PUBLICATIONS

Riviere et al. ("On the Coupling of Finite Volume and Discontinuous Galerkin for Reservoir Simulation Problems", Society of Petroleum Engineers, 2011, pp. 1-8).*

Hyman et al. ("Mimetic finite difference methods for diffusion equations", Kluwer Academic Publishers, 2002).*

Chung et al. ("Optimal Discontinious Gaerkin Methods for Wave Propagation", Society for Industrial and Applied Mathematics, 2006).*

Coats "An Equation of State Compositional Model" (Oct. 1980, Society of Petroleum Engineering), pp. 363-376.

Das, "Diffusion and Dspersion in the Simulation of Vapex Process," SPE, Petroleum Society, Canadian Heavy Oil Assoc., 97924 (2005).

De Basabe, et al. "Grid Dispersion of the Discontinuous Galerkin Method for Elastic Wave Propagation," SEG Las Vegas 2008 Annual Meeting.

Hoteit, H. "Finite Element Methods in Reservoir Simulation: Luxury or necessity?," SPE Distinguished Lecturer Program, 2007.

Naguib, et al. "Optimizing Field Performance Using Reservoir Modeling and Simulation" SPE 70037-MS, SPE Permian Basin Oil and Gas Recovery Conference, May 15-17, 2001, Midland, Texas.

Nakashima, et al. "Development of an equation of state fully implicit compositional model," Sekiyu Gijutsu Kyokaishi, vol. 65, No. 4, pp. 342-351, 2000.

Oladyshkin and Panfilov, "Limit thermodynamic model for compositional gas—liquid systems moving in a porous medium," Transport in Porous Media, vol. 70, No. 21 Nov. 2007.

* cited by examiner

A

B

HEAT FRONT CAPTURE IN THERMAL RECOVERY SIMULATIONS OF HYDROCARBON RESERVOIRS

CROSS REFERENCE TO RELATED APPLICATIONS

None.

STATEMENT OF FEDERALLY SPONSORED RESEARCH

None.

FIELD OF THE DISCLOSURE

The present invention relates generally to a method for simulating oil recovery processes in hydrocarbon reservoirs. In one embodiment, a numerical model to simulate hot fluid injection in viscous and heavy oil reservoirs.

BACKGROUND OF THE DISCLOSURE

Viscous and heavy oil subsurface deposits represent a significant portion of the recoverable hydrocarbon reserve in the world. Heavy hydrocarbons cannot be efficiently recovered by the conventional oil recovery techniques (primary and secondary) because of relatively high viscosity and therefore low mobility of oil. Hot fluid injection is one of the successful techniques that is currently adopted in the industry to reduce oil viscosity and mobilize oil towards the production wells. Numerical methods are widely used in the oil industry as a means to model the mechanisms that dominate fluid flow behavior in the subterranean formation. Computer simulations help to predict reservoir performance with different scenarios that are intended to optimize recovery processes and the corresponding economic forecast.

In reservoir simulation, numerical methods are used to approximate the solution of the mathematical equations that describe the material balance and dynamic behavior of multiphase, multicomponent fluid flow in the subsurface. The simulation model predicts the thermodynamic behavior of several hydrocarbon components under certain temperature and pressure conditions, the interaction between the fluids and the rock formation, and rock mechanics. Reservoir simulation, in a larger sense, coordinates the underground transient flow behavior with the surface processing facilities that manage the injection and production rates in the wells and the surface flowlines constraints.

Two types of simulation models are common in reservoir simulation literature: compositional and black oil. In a compositional model, the number of components and pseudo-components is typically around ten and the thermodynamic phase behavior is usually modeled by an equation of state (EOS). The EOS predicts the phase split of a mixture into gas and oil phases and estimates the compositions of each phase. The black-oil model is a simplification of the compositional model. It incorporates simulation of three components that correspond to gas, oil, and water phases.

In conventional oil recovery models, temporal and spatial variations of the temperature in the reservoir are usually negligible. The system is considered isothermal and therefore solving the energy equation is not needed. In thermal recovery processes, however, the energy equation should be solved in conjunction with the flow equations.

Simulation models require input data that describe reservoir geometry, rock properties such as porosity and permeability, fluid properties such as fluid composition, and pressure-volume-temperatures (PVT) information of the fluid, and well production and injection data.

Finite difference (FD) is one of the numerical methods that is mostly used in commercial reservoir simulators. In this method, the reservoir geometry is subdivided into a grid composed of contiguous and non-overlapping volume entities known as grid-cells or grid-blocks. Two grid-types are commonly used in reservoir simulation literature: regular Cartesian grid and irregular corner-point-geometry grid. Rock properties are assigned to each grid-block and the sought variables such as the pressure, phase saturations and composition are calculated as average values in the grid-blocks. The number of grid-blocks in a simulation model depends on the desired resolution of the solution, the size of the reservoir, and the level of geological complexities, such as number of faults and rock heterogeneities.

In the FD scheme, the Taylor series expansion is used to define the derivative functions in governing flow and energy equations. Most commercial models use the first order form of the approximation of derivatives. As a result, state variables such as saturation, composition and temperature are computed to be constant in a computational grid-block. There are a few inherent advantages of the finite-difference method including: 1) simplicity; 2) ease of extension from 1D to 2D and 3D; and 3) compatibility with certain aspects of physics of two- and three-phase flow. On the other hand, one of the major disadvantage of the FD method is that it provides poor accuracy if the solution has sharp changes in space such as in case of moving heat front in hot fluid injection process. The FD method may introduce significant numerical dispersion that smears sharp fronts in the solution. An assessment of numerical dispersion influence in isothermal compositional modeling is provided by Coats "An Equation of State Compositional Moder' (October 1980, Society of Petroleum Engineering), pp. 363-376. In hot fluid injection processes in heavy oil reservoirs, temperature has significant influence on oil viscosity and consequently on the ultimate oil recovery prediction. Accurate prediction of the heat front is therefore crucial. The need for fine gridding in thermal recovery models, such as steam-assisted-gravity-drainage (SAGD) is shown by Card et al. "Numerical Modeling of Advanced In-Situ Recovery Processes in Complex Heavy-Oil and Bituman Reservoirs" (November 2005, Society of Petroleum Engineering, SPE97476). The SAGD process is described in the Canadian patent 1,304,287.

The FD method may require an excessive number of grid-blocks to improve the accuracy of the solution, which eventually may add significant computation time. U.S. Pat. No. 7,164,990 B2 uses a streamline method to reduce numerical dispersion in the FD method. Dynamic grid refinement is another technique suggested in the literature to reduce the number of grid-blocks in unwanted regions in the reservoir. One embodiment of Dynamic grid refinement is described by Sammon (*Dynamic Grid Refinement and Amalgamation for Compositional simulation*" (February 2003, Society of Petroleum Engineering, SPE79683).

BRIEF DESCRIPTION OF THE DISCLOSURE

Briefly, the present invention comprises a numerical procedure for simulating thermal recovery processes in heavy oil reservoirs. The numerical procedure combines the traditional FD method and the DG method. The FD method is used to solve the flow equation to approximate the pressure, saturations, and compositions. The DG method is used to solve the energy equation to approximate the temperature and the enthalpies. The combined FD-DG method, proposed in the invention, is an alternative to the traditional approach that uses the FD method to solve the flow and energy equations. The DG method is monotonic and locally conservative of energy at the grid-block level. The DG method can be used in ID, 2D and 3D grids. The type of the grid can be Cartesian or corner-point-geometry. This invention suggests using linear approximation of temperature within a grid-block. Therefore, the temperature can vary linearly within a grid-block. In the traditional FD method, the temperature is assumed to be constant within a grid-block. Non-constant temperature in a grid-block improves the accuracy of temperature at the grid-block interfaces which provides an improved approximation of the mobility coefficient that eventually affects the thermal flux between grid-blocks. The DG method can, therefore, reduce numerical dispersion and improve the accuracy of temperature near sharp fronts. The traditional FD method may require orders of magnitude more grid-blocks in a fine grid to attain a comparable accuracy as the DG method on a coarse grid.

In one embodiment, dynamic reservoir simulation is described by partitioning a reservoir geometry into one or more grid-blocks in 1D, 2D or 3D space; assigning fluid and rock properties to one or more grid-blocks; assigning boundary conditions and well properties to one or more grid-blocks; solving the pressure, material balance, and energy balance equations wherein the pressure equation and material balance equation are solved by the finite difference (FD) method and the energy equation is solved by discontinuous Galerkin (DG) method; and simulating reservoir properties across one or more grid-blocks.

In another embodiment, a dynamic reservoir simulation is accomplished by partitioning a reservoir geometry into one or more grid-blocks in 1D, 2D or 3D space; assigning fluid and rock properties to one or more grid-blocks; assigning boundary conditions and well properties to one or more grid-blocks; calculate the average temperature at the center of the grid blocks and the temperatures at the grid blocks interfaces, apply a slope limiter to improve stability of the analysis, use the interface temperatures to calculate thermal fluxes among grid-blocks; solving the pressure, material balance, and energy balance equations wherein the pressure equation and material balance equation are solved by the finite difference (FD) method and the energy equation is solved by discontinuous Galerkin (DG) method; and simulating reservoir properties across one or more grid-blocks.

Grid-blocks can use a variety of geometries including Cartesian, corner-point-geometry, static, dynamic, radial, curvilinear, and combinations thereof. The methods described are flexible and pressure, material balance, or energy balance equations may be applied in Implicit Pressure-Explicit Saturation (IMPES), fully implicit models, adaptive implicit model, or the like. The reservoir may be simulated using a thermal model, steam-flooding model, steam-assisted gravity drainage (SAGD) model, black-oil model, compositional model, finite-difference simulator, or the like. The average temperature and the temperature differences at the grid-block interface may be calculated for each grid. The methods may use 2 degrees of freedom in a 1D model, 3 degrees of freedom in a 2D model, or 4 degrees of freedom in a 3D model. The $\alpha$-slope limiter may be any between 0 and 1 including but not limited to 0, 0.1, 0.2, 0.3, 0.4, 0.5, 0.6, 0.7, 0.8, 0.9, 1.0, or may be carried out to the 100ths, 1000ths or even finer resolution.

DETAILED DESCRIPTION OF EMBODIMENTS OF THE INVENTION

Figure 1:
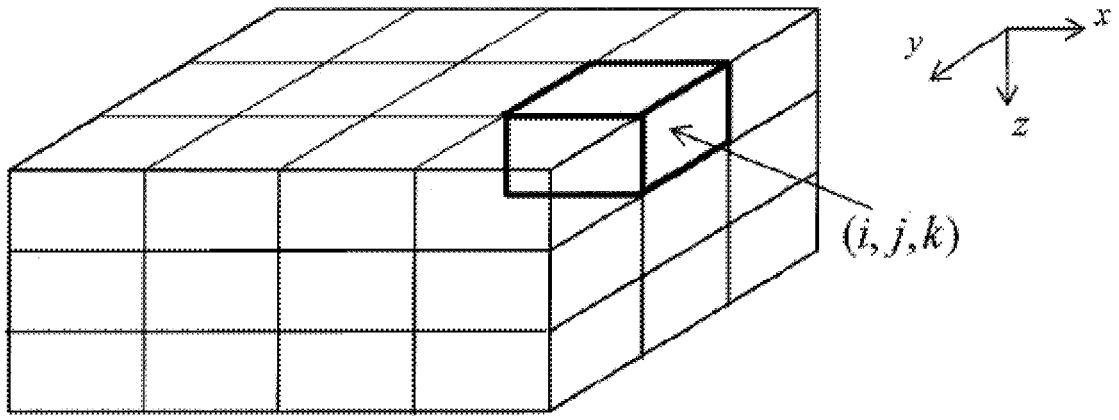
FIG. 1: A 3D Cartesian grid.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In simulating hot fluid injection in heavy oil reservoir, the accuracy of the temperature solution is crucial. The FD method that is used in most of the thermal simulators has an inherent limitation. The FD method may produce significant numerical dispersion that results in smearing sharp fronts of temperature and therefore degrades the accuracy of the solution. A common practice to restore the accuracy is to refine the grid by increasing the number of grid-blocks. Since the FD method is a first order approximation scheme, the improvement in accuracy as a response to reaming the grid is slow. In some thermal simulation problems, the need for excessive number of grid-blocks increases significantly the computational time and therefore makes the simulation impractical.

The present invention provides a solution method to improve the accuracy of the temperature solution without increasing the number of grid-blocks in the model. The solution method combines the FD method and the DG method. The DG method is superior to the FD method but yet preserves the favorable features of the FD method such as, simplicity to apply, local material conservation, and the monotonic behavior that guarantees non-oscillatory solution. The second order approximation used with the DG method results in faster and more accurate solution for the energy equation. In the present solution approach, the DG method is only applied to the energy equation. The flow equations are solved with the traditional FD method. The DG method can be used in ID, 2D and 3D geometries with Cartesian and corner-point-geometry grids. The method is stabilized by a post-processing procedure known as a slope limiter.

One main embodiment in this invention is the use of the DG method to approximate the energy equation. Another embodiment is a new generalized slope limiter procedure named as the $\alpha$-slope limiter. In the following, the DG will be presented in details for Cartesian and Corner-point-geometry grids in ID, 2D, and 3D. The α-slope limiter is then described. Several examples to prove the concept are also provided.

The DG Method

The DG method is proposed as an alternative to the FD method in solving the energy equation. In the traditional first-order FD method, only one temperature variable is calculated in each grid-block. This variable represents a grid-block average temperature and is appointed at the center of the grid-block. The average grid-block temperature is used to calculate the thermal flux between adjacent grid-blocks. The DG method, however, allows the temperature to vary within the grid-block. Different orders of variation can be used to approximate the temperature. The complexity in applying the DG method increases with the order of approximation. However, second-order approximation by using linear variation of temperature adequately fulfils simplicity, accuracy and efficiency of the DG method.

Consider a 3D grid with the typical i, j, and k indexing of grid-blocks, as shown in FIG. 1. A grid-block (i, j, k) refers to the volume-block that is in the ith position in the x-direction, the jth position in the y direction, and the $k^{th}$ position in the z-direction.

A key peculiarity in the present DG method is to model the temperature T(x,y,z,t) as a function of space variables (x, y, z) and time t. In a 3D grid-block (i, j, k), the temperature function is written in terms of four temperature variables, $\overline{T}$, $T_x$, $T_y$, and $T_z$ as follows:

$$T(x,y,z,t)=\overline{T}(t)+\phi_x(x,y,z)T_x(t)+\phi_y(x,y,z)T_y(t)+\phi_z(x,y,z)T_z(t) \quad (1)$$

where: $\overline{T}$ is the average temperature in grid-block (i, j, k); $T_x$, $T_y$, and $T_z$ are the variations in temperature in grid-block (i, j, k) in the x-, y-, and z-directions, respectively; $\phi_x$, $\phi_y$, and $\phi_z$ are space functions used to model the temperature variation in the x-, y-, and z-directions, respectively.

The temperature variables $\overline{T}$, $T_x$, $T_y$ and $T_z$ are calculated at every time-step in the grid-block (i, j, k). The space functions $\phi_x$, $\phi_y$, and $\phi_z$ are time independent. They depend on the grid-block, dimensions and geometry and are calculated only once in the simulation. The set of functions $\{1, \phi_x, \phi_y, \phi_z\}$ forms a basis to the DG approximation space and the variables $\overline{T}$, $T_x$, $T_y$ and $T_z$ are the corresponding degrees of freedom.

Modeling the energy equation by the DG approximation will be discussed in further detail. The definition of the basis functions on Cartesian grids and corner-point-geometry grids are enclosed hereinafter.

DG Basis Functions on Cartesian Grids

Figure 2:
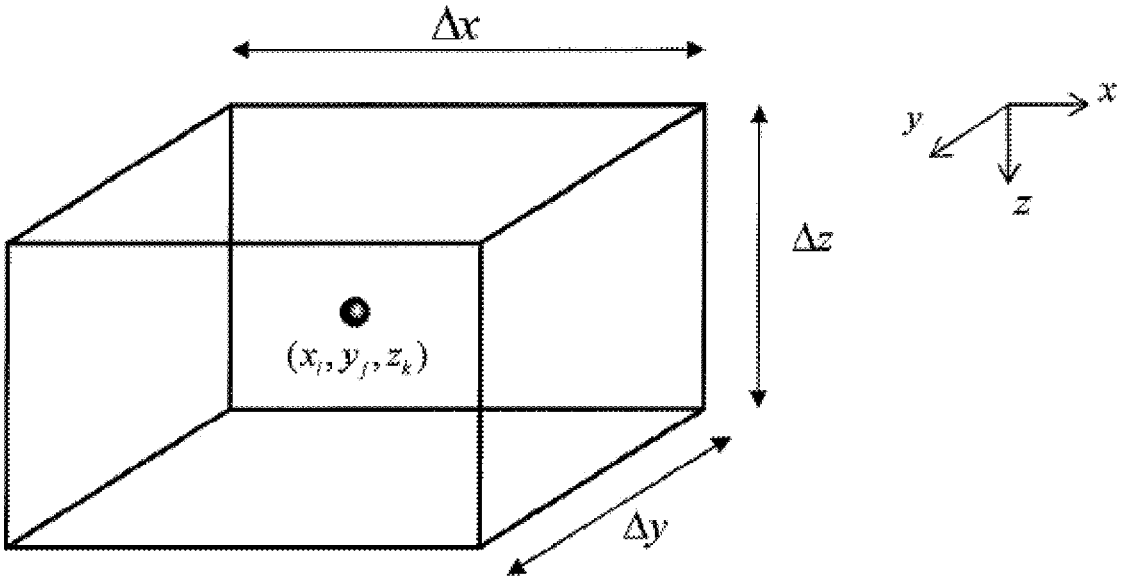
FIG. 2: A grid-block with dimensions $\Delta x$, $\Delta y$, and $\Delta z$, and center $(x_i, y_j, z_k)$.

Consider a structured grid-block (i, j, k), as shown in FIG. 2. All the opposite faces of the grid-block are parallel and the intersecting faces are perpendicular. The center of the grid-block is referred by the point $(x_i, y_j, z_k)$ and the dimensions are Δx, Δy, Δz in the x-, y-, and z-directions, respectively.

The basis functions become:

$$\varphi_x(x) = 2\left(\frac{x-x_i}{\Delta x}\right),\ \varphi_y(y) = 2\left(\frac{y-y_i}{\Delta y}\right),\ \varphi_z(z) = 2\left(\frac{z-z_i}{\Delta z}\right) \quad (2)$$

The interpretation of these functions is discussed in details in ID, 2D and 3D as follows.

Approximation Method in 1D Space

Figure 3:
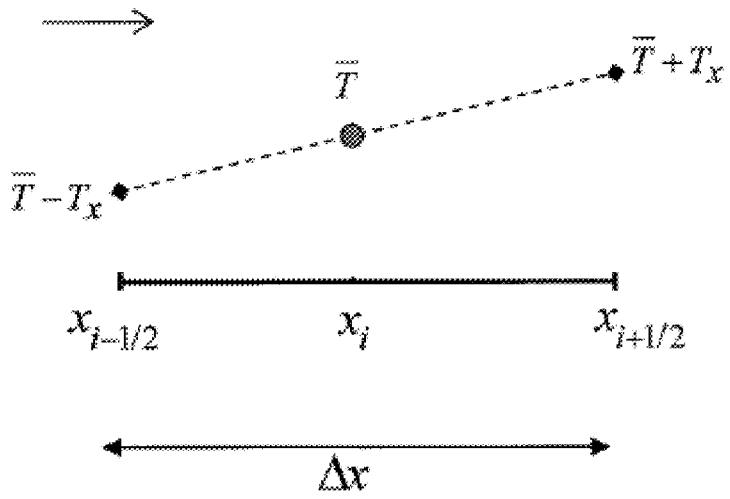
FIG. 3: Temperature distribution in a 1D grid-cell.

FIG. 3 presents a 1D grid-cell where the center of the cell and the two end points are denoted by $x_i$, $x_{i+1/2}$, and $x_{i-1/2}$. From Eq. (1), the temperature approximation in the 1D grid-cell becomes:

$$T(x,t)=\overline{T}(t)+\phi_x(x)T_x(t) \quad (3)$$

The basis function $\phi_x$, is linear in the grid-cell and has the values:

$$\phi_x(x)=0;\phi_x(x_{i+1/2})=1;\phi_x(x_{i-1/2})=-1; \quad (4)$$

As a result, the temperature function given in Eq. (3) satisfies:

$$T(x_i)=\overline{T};T(x_{i+1/2})=\overline{T}+T_x;T(x_{i-1/2})=\overline{T}-T_x \quad (5)$$

A sketch that shows the behavior of the temperature function is shown in FIG. 3.

If $T_x$ is set to zero in Eq. (3), the temperature will be constant and equal to the average temperature. In such a case, the method will be equivalent to the traditional FD method.

Approximation Method in 2D Space

In 2D space, the temperature approximation function in a grid-cell becomes:

$$T(x,y,t)=\overline{T}(t)+\phi_x(x)T_x(t)+\phi_y(y)T_y(t) \quad (6)$$

Figure 4:
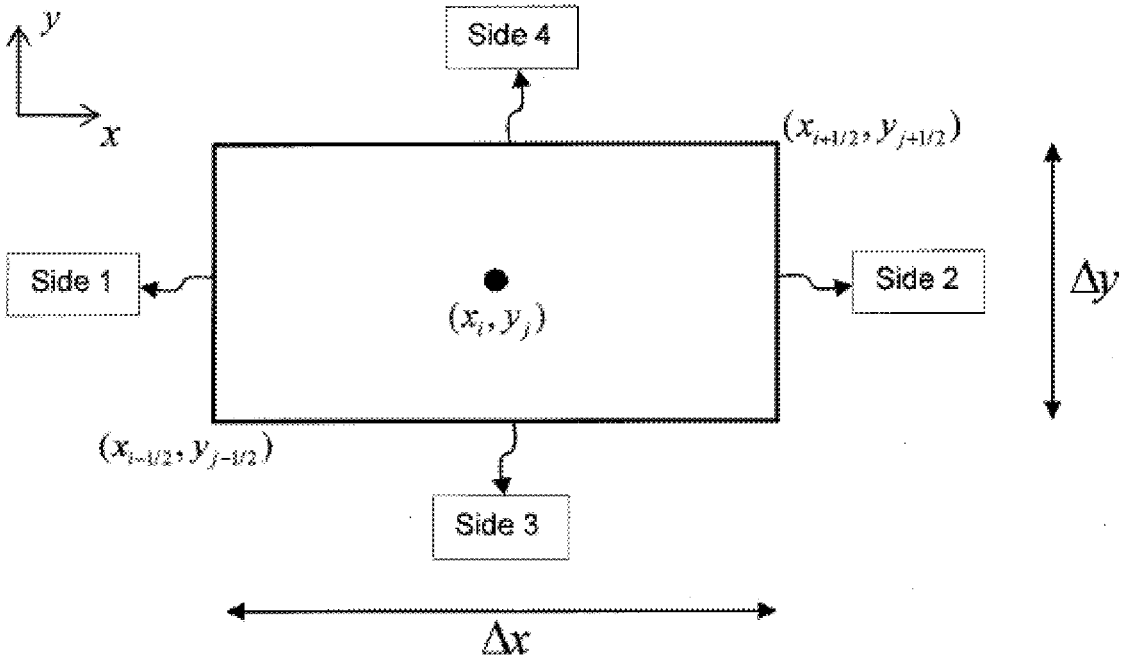
FIG. 4: A 2D grid-cell labeled at the corners, center, and faces.
Figure 5:
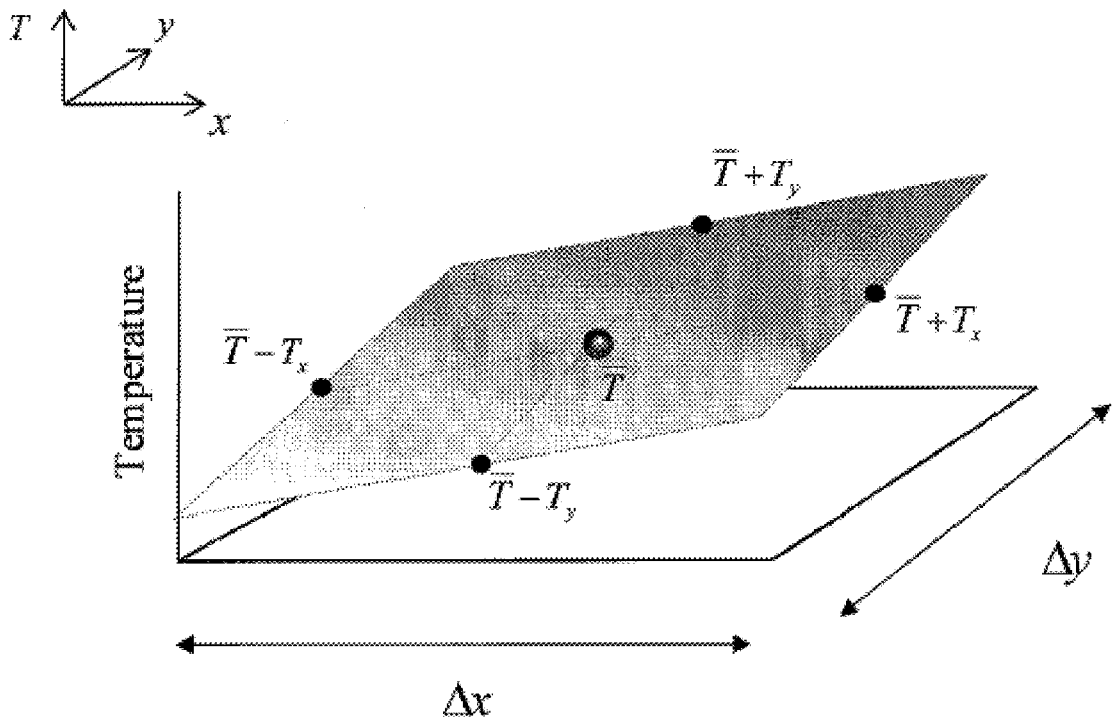
FIG. 5: Temperature distribution over a 2D grid-cell.

Consider a grid-cell with four sides labeled as shown in FIG. 4. The basis functions vanish at the center of the grid-cell. Form Eq. (2), the function $\phi_x$ is constant and equal to −1 and 1 on the sides 1 and 2 of the grid-cell, respectively, as appears in FIG. 4. Similarly, the function $\phi_y$, is constant and equal to −1 and 1 on the sides 3 and 4, respectively. A draw of the behavior of the temperature distribution within the grid-cell is shown in FIG. 5. If $T_x$ and $T_y$ are set to zero, the method will be equivalent to the traditional FD method.

Approximation Method in 3D Space

In 3D space, the temperature approximation function in a grid-cell becomes:

$$T(x,y,z,t)=\overline{T}(t)+\phi_x(x)T_x(t)+\phi_y(x,y,z)T_y(t)+\phi_z(x,y,z)T_z(t) \quad (7)$$

Figure 6:
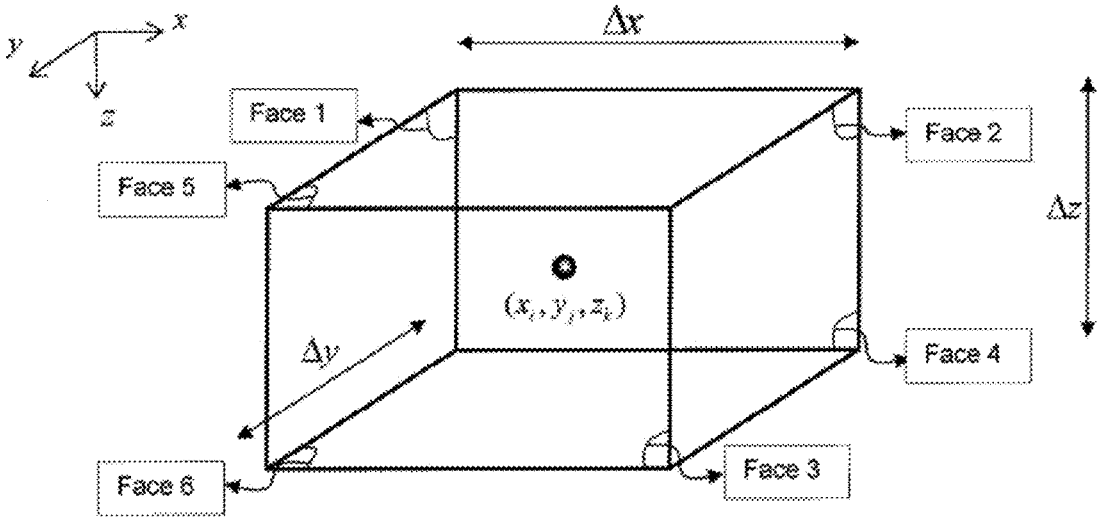
FIG. 6: A 3D grid-block with the labels of the center and the faces.

The basis functions are defined in Eq. (2) and have similar properties as those discussed in 1D and 2D approximation spaces. Consider a 3D grid-block with the faces labeling as shown in FIG. 6. The function $\phi_x$ is constant and equal to −1 and 1 on the faces 1 and 2, respectively, $\phi_y$ is constant and equal to −1 and 1 on the faces 3 and 4, respectively, and $\phi_z$ is constant and equal to −1 and 1 on the faces 5 and 6, respectively. All the functions vanish at the center of the grid-block. If $T_x$, $T_y$ and $T_z$ are set to zero, the method will be equivalent to the traditional FD method.

Because of the spatial splitting nature of the temperature approximation function along the x-, y-, and z-directions, any of the temperature variables $T_x$, $T_y$ and $T_z$ can be neglected without affecting the validity of the method. In some applications such as in the case of hot fluid flooding in a thin reservoir, temperature may not change significantly with the depth of the reservoir. Therefore, relaxing the order of approximation of temperature in the z-direction by setting $T_z$ to zero will improve computational time without major effect on the ultimate solution.

DG Basis Functions on Corner-Point-Geometry Grids

Field scale reservoir simulations are usually carried out with corner-point-geometry grids. Corner-point geometry grids are more suitable than center-point Cartesian grids in describing complex reservoir structure. In corner-point-geometry grids, a grid-block, that can have a distorted shape, is defined by the coordinated of its eight corners.

Figure 7:
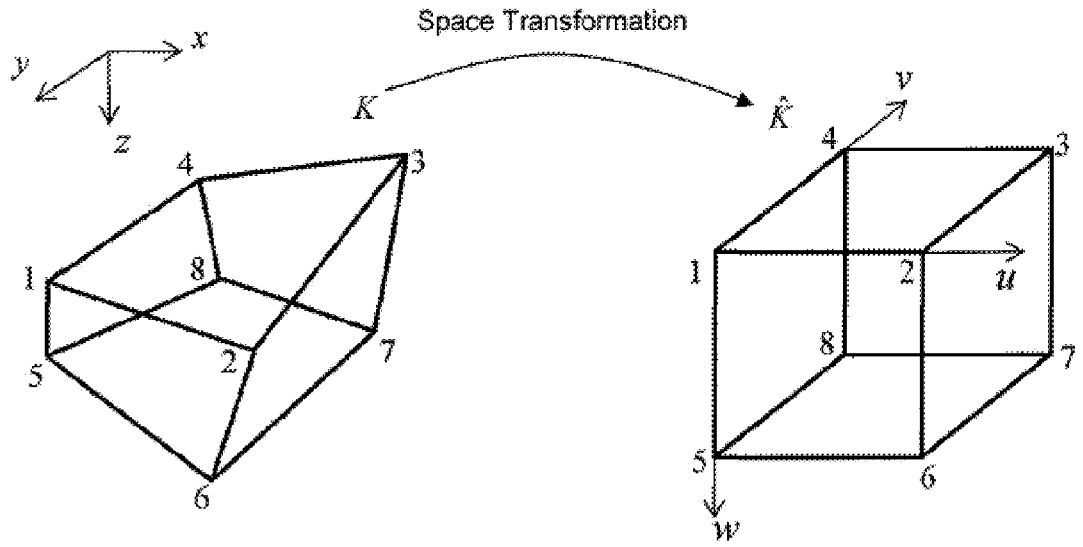
FIG. 7: Transformation from a grid-block distorted in the regular xyz space to the unit cube in computational uvw space.

Consider an irregular shaped grid-block K using corner points as shown in FIG. 7*a*. The grid-block is defined in the natural xyz space by the eight corners labeled from 1 to 8 as appears on the sketch. To perform the DG approximation on K, we introduce a 3D isoperimetric transformation between the grid block K in the xyz coordinate system and a unit cube K in a uvw coordinate system, which will be the computational space. A sketch of the transformation is shown in FIGS. 7*a* and 7*b*.

The basis functions of the DG method in the uvw space are $\{1, \phi_u, \phi_v, \phi_w\}$, where, $$\phi_u(x)=2u-1, \phi_v(y)=2v-1; \phi_w(z)=2w-1 \tag{8}$$

The functions in Eq. (8), that are defined on the unit cube, are special case of those given in Eq. (2). Let $\hat{M}$ be any point located in the unit cube in the uvw space and has the coordinates (u, v, w). The transformation point M of $\hat{M}$ will therefore have the coordinates (x(u, v, w), y(u, v, w), z(u, v, w) in the xyz space, defined as follows:

$$x(u, v, w) = \sum_{i-1}^{8} N_i x_i \tag{9}$$

$$y(u, v, w) = \sum_{i-1}^{8} N_i y_i$$

$$z(u, v, w) = \sum_{i-1}^{8} N_i z_i$$

Where, $(x_i, y_i, z_i)$ for i=1, . . . , 8 are the coordinates of the eight corners of the grid-block K in the xyz space, and Ni for i=1, . . . , 8 are interpolation functions given by:

$$N_1=(1-u)(1-v)(1-w); N_2=u(1-v)(1-w)$$

$$N_3=uv(1-w); N_4=(1-u)v(1-w)$$

$$N_5=(1-u)(1-v)w; N_6=u(1-v)w$$

$$N_7=uvw; N_8=(1-u)vw \tag{10}$$

The integration of any scalar function f(x, y, z) over the grid-block K is transformed as follows:

$$\int_K f(x, y, z)\, dx\, dy\, dz = \int_K f(x(u, v, w), y(u, v, w), z(u, v, w)) det(J)\, du\, dv\, dw \tag{11}$$

In the above equation, det(J) denotes the determinate of the Jacobian matrix J, where, $$J = \begin{bmatrix} \frac{dx}{du} & \frac{dx}{dv} & \frac{dx}{dw} \\ \frac{dy}{du} & \frac{dy}{dv} & \frac{dy}{dw} \\ \frac{dz}{du} & \frac{dz}{dv} & \frac{dz}{dw} \end{bmatrix} \tag{12}$$

The partial derivatives in Eq. (12) can be readily computed from Eqs. (9) and (10).

DG Approximation of the Energy Equation

The partial differential equation that describes the conservation of energy in a three-phase system is given by:

$$\frac{\partial}{\partial t}(\phi(U_o\rho_0 S_0 + U_g\rho_g S_g + U_w\rho_w S_w) + (1-\phi)\rho_s U_s) = \nabla.(H_0\rho_0 S_0 + H_g\rho_g S_g + H_w\rho_w S_w) + q \tag{13}$$

where the subscribes o, g, w, and s refer to the oil, gas, water, and solid faces, respectively. U is phase internal energy, S is phase saturation, P is phase molar density, H is phase enthalpy, and q represents thermal conductivity and external sink/source.

To simplify the DG formulation, Eq. (13) is written in the compressed form:

$$\frac{\partial}{\partial t}\left(\sum_{l=o,g,w,s} \beta_l U_l\right) = \nabla.\left(\sum_{l=o,g,w} \gamma_l H_l\right) + q \tag{14}$$

The coefficients $U_l$ and $H_l$ in Eq. (14) can be readily deduced form Eq. 15.

The DG formulation in a 3D Cartesian grid is described in a three-step procedure as follows:

Step 1

The phase internal energy $U_l$ and enthalpy $H_l$ are functions of temperature. Therefore, they are approximated linearly similar to the temperature approximation, as shown in Eq. (7). The approximation functions of $U_l$ and $H_l$ become:

$$U_l=\overline{U}_l+\phi_x U_{lx}+\phi_y U_{ly}+\phi_z U_{lz}$$

$$H_l=\overline{H}_l+\phi_x H_{lx}+\phi_y H_{ly}+\phi_z H_{lz} \tag{15}$$

Step 2

Let ψ be one of the DG basis functions $\{1, \phi_u, \phi_v, \phi_w\}$ which are defined in Eq. (2). Eq. (14) is then multiplied by ψ and intergraded locally over the grid-blocks, that is, $$\frac{\partial}{\partial t}\int_K\left(\sum_{l=o,g,w,s} \beta_l U_l \psi\right) = \int_K \nabla.\left(\sum_{l=o,g,w} \gamma_l H_l\right)\psi + \int_K q\psi \tag{16}$$

Using the expressions of $U_l$ and $H_l$ in Eq. (16) and applying the Green's formula to the first integral in the right-hand term in Eq. (16), one obtains:

$$\int_K \sum_{l=o,g,w,s} \beta_l(\overline{U}_l + \varphi_x U_{lx} + \varphi_y U_{ly} + \varphi_z U_{lz})\psi = \int_K\left(\sum_{l=o,g,w} \gamma_l(\overline{H}_l + \varphi_x H_{lx} + \varphi_y H_{ly} + \varphi_z H_{lz})\right)\nabla\psi - \int_{\partial K}\left(\sum_{l=o,g,w} \gamma_l(\overline{H}_l + \varphi_x H_{lx} + \varphi_y H_{ly} + \varphi_z H_{lz})\right)n\psi + \int_K q\psi \tag{17}$$

for $\psi=\{1, \phi_x, \phi_y, \phi_z\}$. Where n in the above equation denotes the unit normal vector on the grid-block interface directed outwards. The left-hand term in Eq. (17) represent the energy accumulation. The first and the second terms in the right-hand side of Eq. (17) describe the energy distribution within the grid-block, and energy fluxes across the grid-block boundaries, respectively.

The calculation in Eq. (17) requires the knowledge of the following symmetrical system:

$$\begin{pmatrix} \int_K 1 & \int_K \varphi_x & \int_K \varphi_y & \int_K \varphi_z \\ \int_K \varphi_x & \int_K \varphi_x\varphi_x & \int_K \varphi_x\varphi_y & \int_K \varphi_x\varphi_z \\ \int_K \varphi_y & \int_K \varphi_x\varphi_y & \int_K \varphi_y\varphi_y & \int_K \varphi_y\varphi_z \\ \int_K \varphi_z & \int_K \varphi_x\varphi_z & \int_K \varphi_y\varphi_z & \int_K \varphi_z\varphi_z \end{pmatrix} \tag{18}$$

In a 3D Cartesian grid, the system in Eq. (18) can readily shown to be:

$$\Delta x \Delta y \Delta z \begin{pmatrix} 1 & 0 & 0 & 0 \\ 0 & 1/3 & 0 & 0 \\ 0 & 0 & 1/3 & 0 \\ 0 & 0 & 0 & 1/3 \end{pmatrix} \tag{19}$$

In corner-point-geometry grids, the isoperimetric transformation described in Eqs. (8) through (12) should be used.

It should be noted that when $\psi=1$ in Eq. (17), the first term on the right-hand side equation is zero and therefore the resulting equation to calculate $\overline{T}$ is equivalent to the tradition FD formulation. In other words, to convert a FD procedure to a DG procedure, the only additional calculations in this step is in computing the temperature variables $T_x$, $T_y$ and $T_z$.

Step 3

Apply the $\alpha$-slope limiter to all grid-blocks. A detailed description of the enclosed slope limiter is provided below.

The $\alpha$-Slope Limiter

A slope limiter is utilized to stabilize the DG method. It is applied in a post-processing step to avoid spurious oscillations near shocks and discontinuities in the solution. The disclosed $\alpha$-slope limiter is introduced in ID, and multidimensional space as follows.

Figure 8:
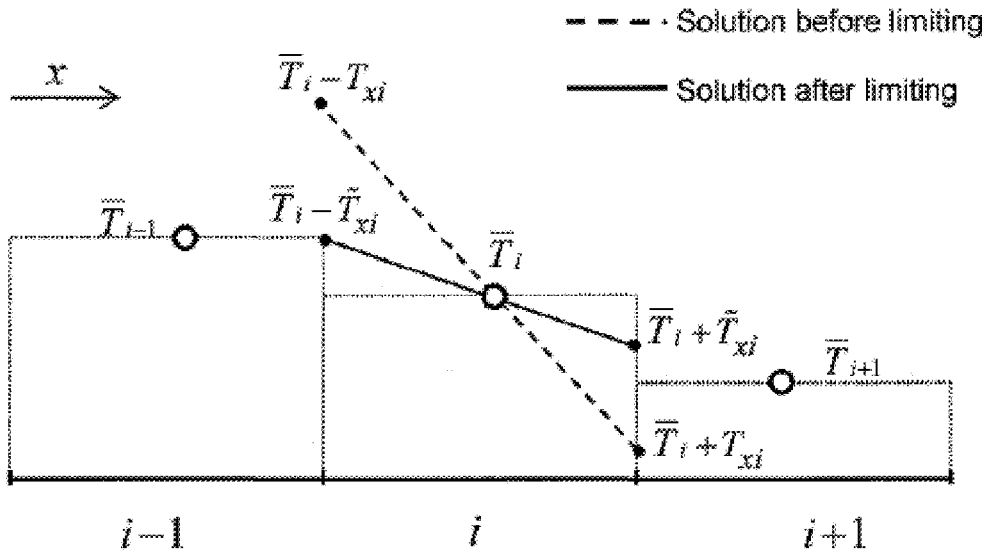
FIG. 8: Limiting procedure in a 1D grid-cell.

Consider a 1D grid-cell labeled as i and the two adjacent grid-cell i−1, and i+1. FIG. 8 shows a sketch of the grid-cells. As previously shown in Eq. (3), the DG method seeks two degrees of freedom: the temperature average $\overline{T}_i$ at the center of the cell and the temperature difference $T_{xi}$ at the cell boundary. The straight line joining the points $(\overline{T}_i-T_{xi})$, $\overline{T}_i$ and $(T_i+T_{xi})$ represents the temperature distribution within the cell i.

Figure 10:
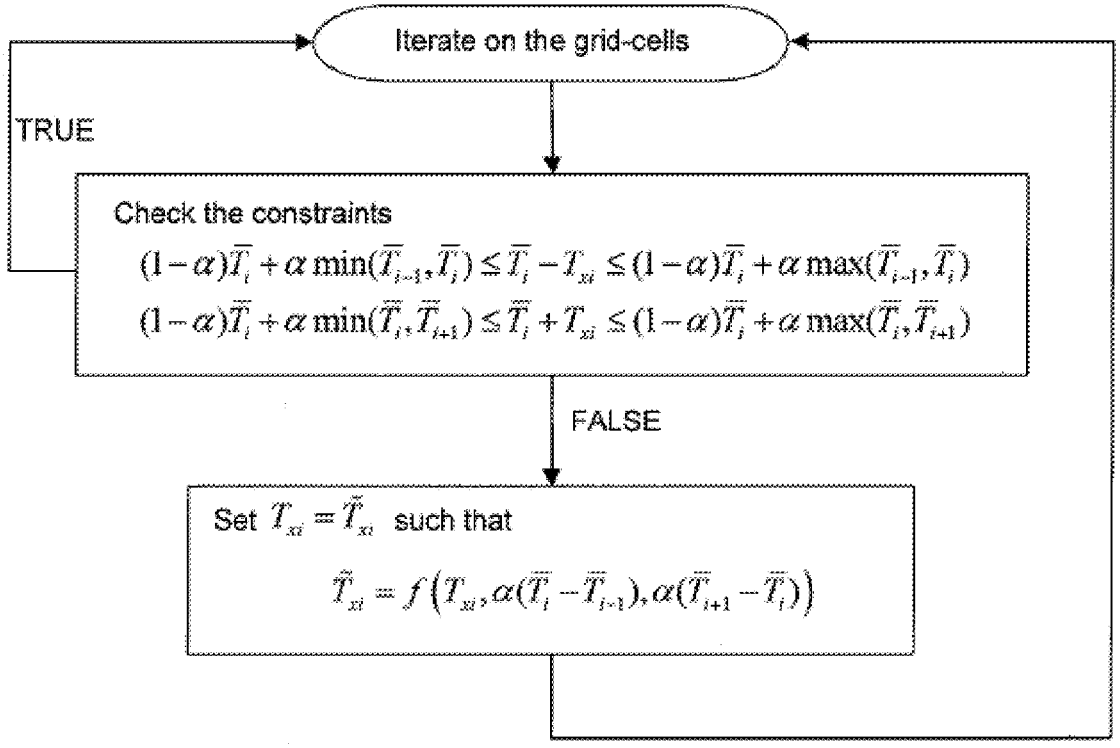
FIG. 10: Flow chart of the slope limiter.

The concept of the $\alpha$-slope limiter is to impose some constraints so that the temperature at the cell boundary is within the minimum and maximum of the average temperatures of the neighboring cells. The $\alpha$-slope limiter is a two-step procedure as described in FIG. 10. The function $f$ in FIG. 10 is known as the minmod function and defined by:

$$f(a_1, a_2, a_3) = \begin{cases} s \min\{a_1, a_2, a_3\} \text{ if } \sin(a_1) = \sin(a_2) = \sin(a_3) \\ \text{otherwise} = 0 \end{cases} \tag{20}$$

FIG. 8 shows the temperature solution in grid-cell i before and after applying the slope limiter. Note that the slope limiter only changes the temperature at the cell boundaries and keeps the average temperature constant.

Figure 9:
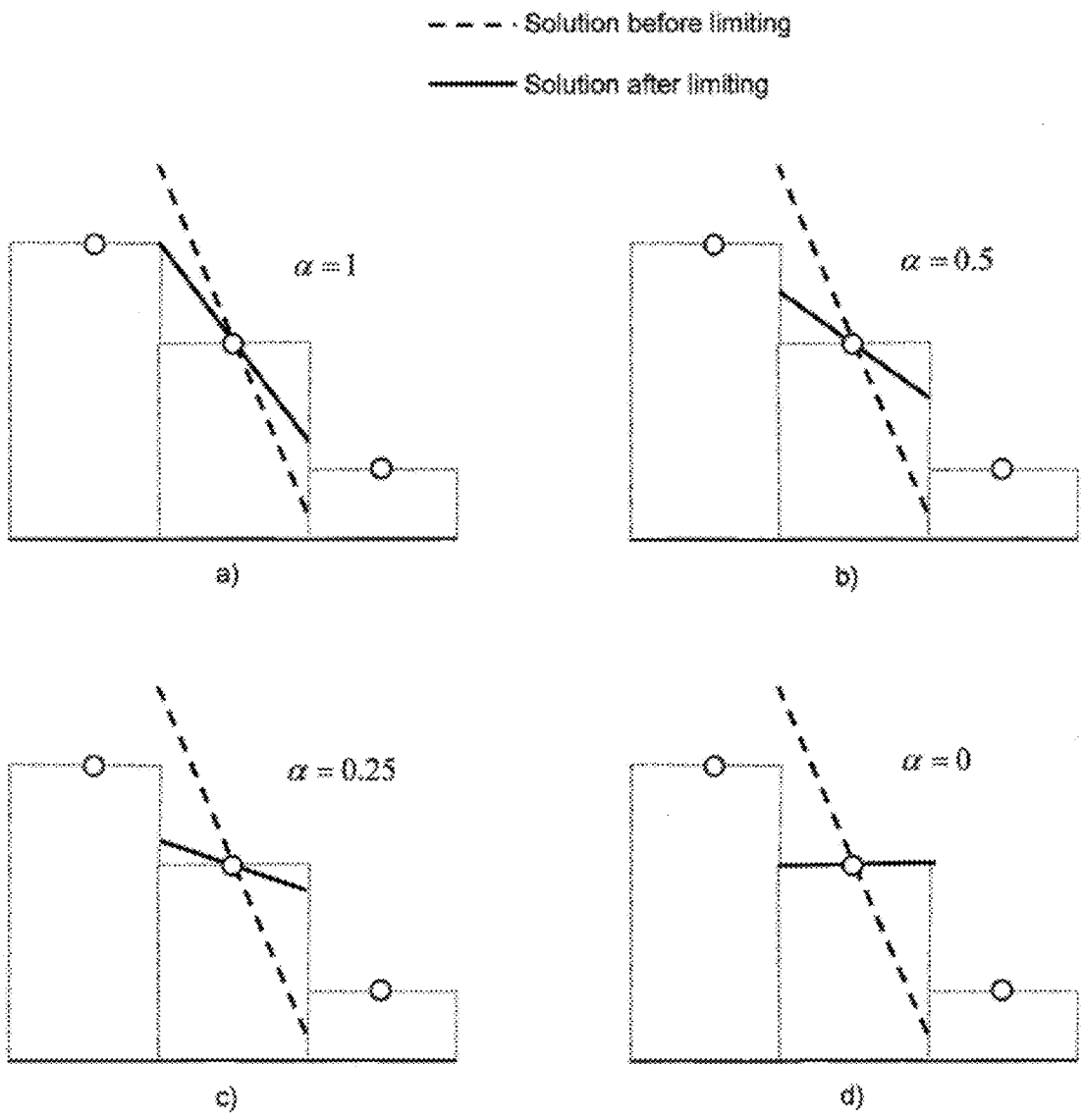
FIG. 9: Behavior of the slope limiter with different values of $\alpha$.

The parameter $\alpha$ can take any value in the interval [0,1]. It controls the level of numerical dispersion introduced by the DG method. If $\alpha$ is set to zero, the slope limiter will impose a constant approximation of temperature and, therefore, the DG method will be equivalent to the FD method. When $\alpha=1$, the slope limiter will be less restrictive and numerical dispersion is minimal. A sketch showing the behavior of the slope limiter for different values of $\alpha$ is given in FIG. 9.

Figure 11:
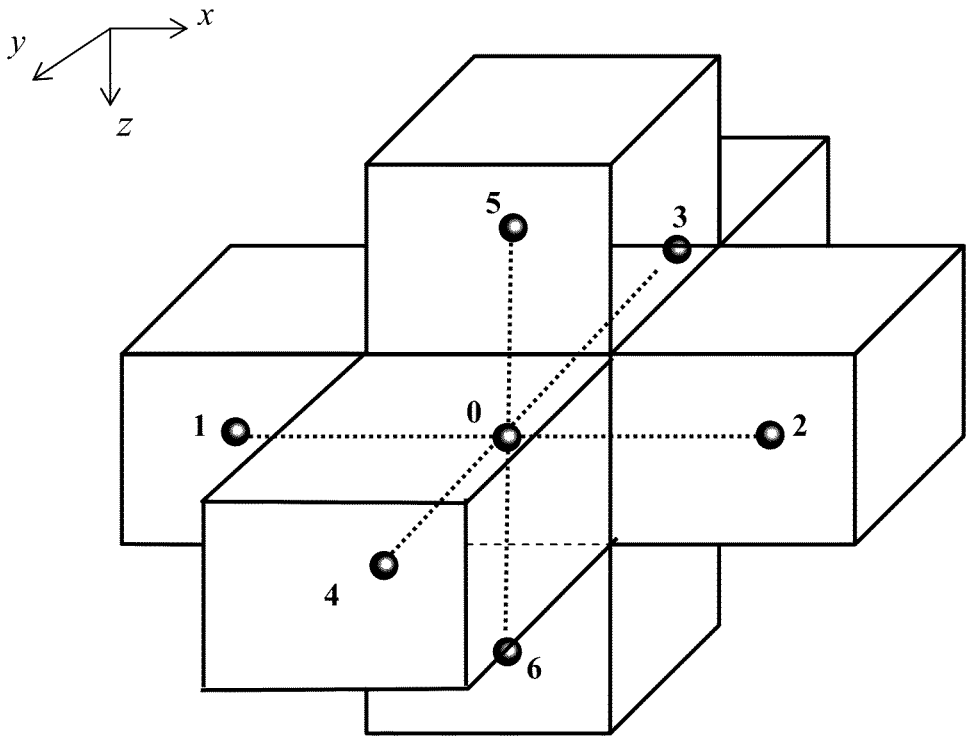
FIG. 11: A 3D grid-block with six connected elements.

The extension of the $\alpha$-slope limiter to multidimensional space is straightforward. The 1D slope limiter is applied in each directional space. In FIG. 11, a grid-block labeled "0" and the neighboring grid-blocks labeled from 1 to 6 represent a typical 7-point stencil. Information from grid-blocks {0,1, 2}, {0,2,3}, and {0,5,6} are used to apply the slope limiter in the x-, y-, and z-directions, respectively.

Test Results and Discussion

The disclosed DG method has been tested and compared with the traditional FD method in solving thermal recovery processes. Two examples 1D and 2D are provided to illustrate the advantage of the disclosed method over the traditional approach. The provided examples are only to proof the concept and the benefit of the DG method is not limited to these cases.

Figure 12:
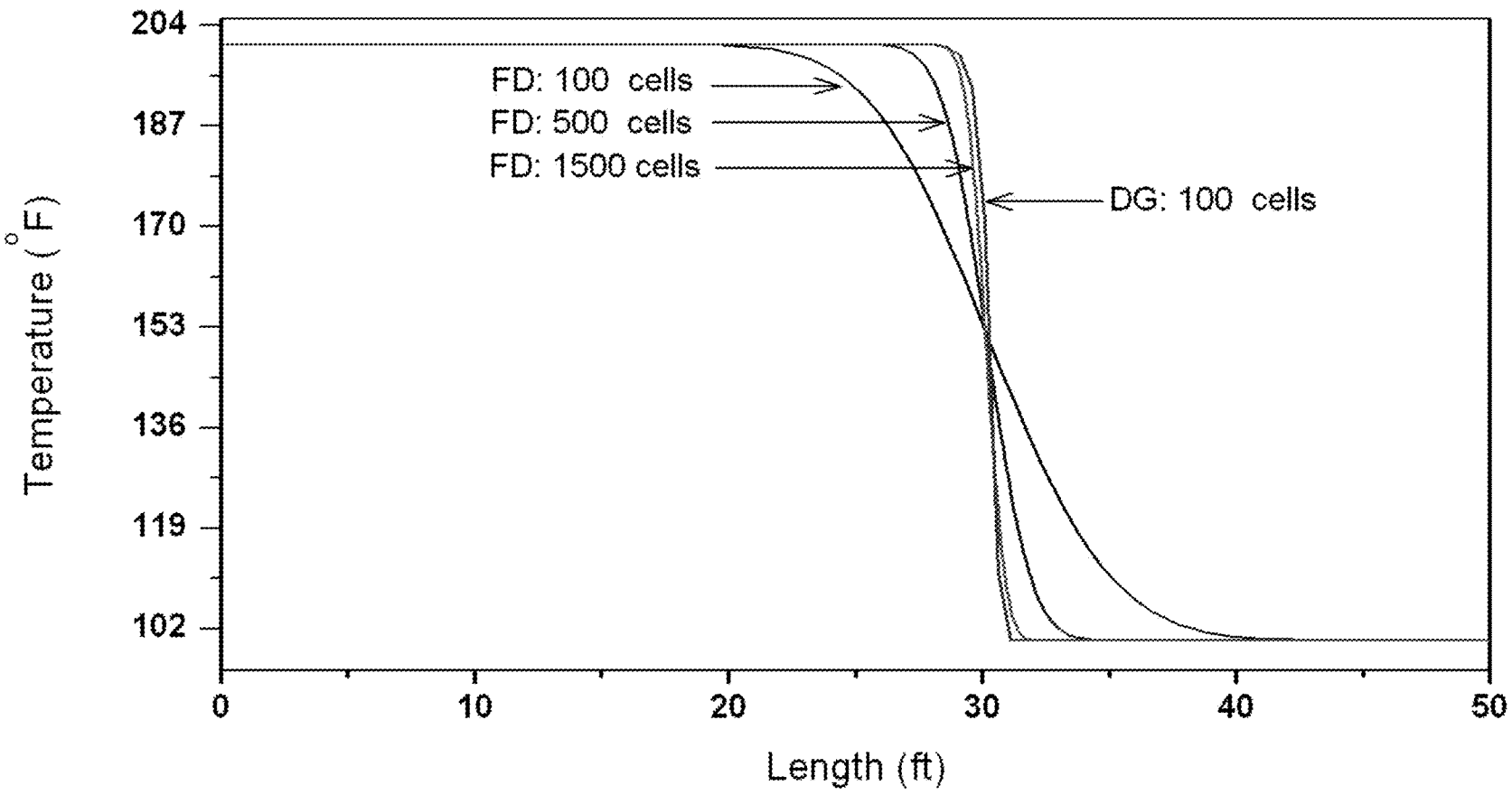
FIG. 12: Temperature versus domain length by the DG and FD methods on grids with different numbers of cells.

In the 1D example, hot fluid is injected in a slim-tube type model. To emphasize the behavior of the disclosed method in approximating thermal convection, which is generally the predominating mechanism in hot fluid injection processes, the 1D system is assumed to be adiabatic and thermal conductivity is ignored. Hot fluid is injected at a constant rate at one end to displace oil to the outlet at the second end. The length of the domain is 50 feet. The disclosed DG method and the FD method are compared on various grids. FIG. 12 shows the solutions of temperature obtained by the FD methods on grids of 100, 500, 1500 cells, and also shows the solution by the DG method on a grid of 100 cells. The FD method produces significant numerical dispersion close to the heat front. The DG solution with 100 grid-cells has comparable accuracy as the FD solution with 1500 grid-cells.

Figure 13:
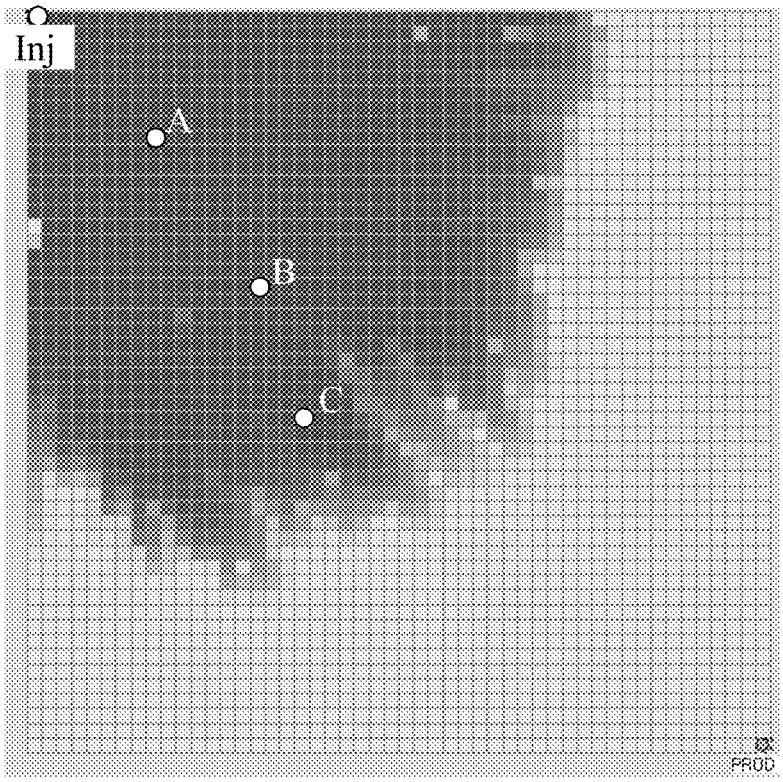
FIG. 13: Temperature distributions by the FD and DG methods on a 50×50 Cartesian grid: A) DG solution, and B) FD solution.
Figure 13:
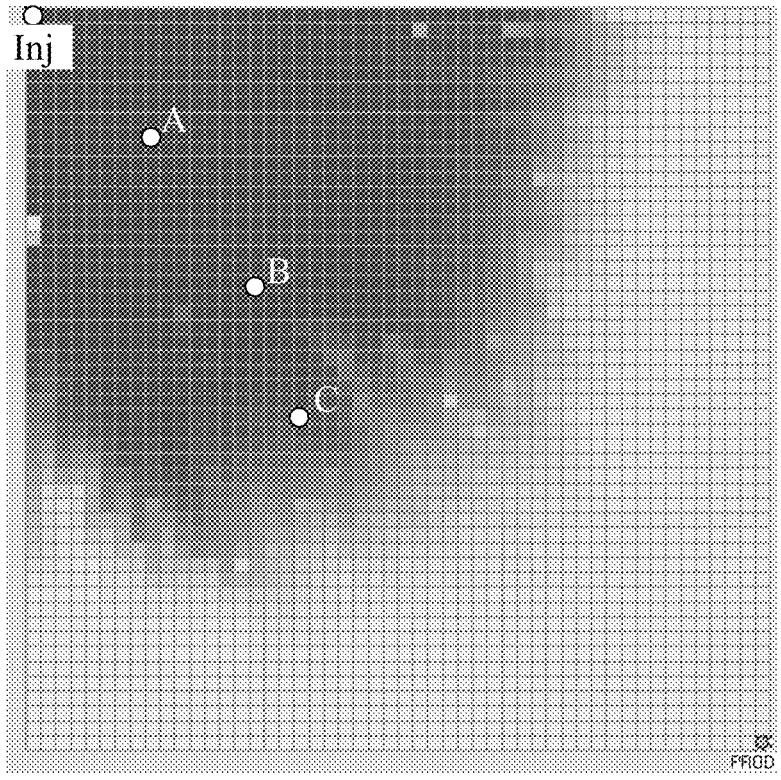
Figure 14:
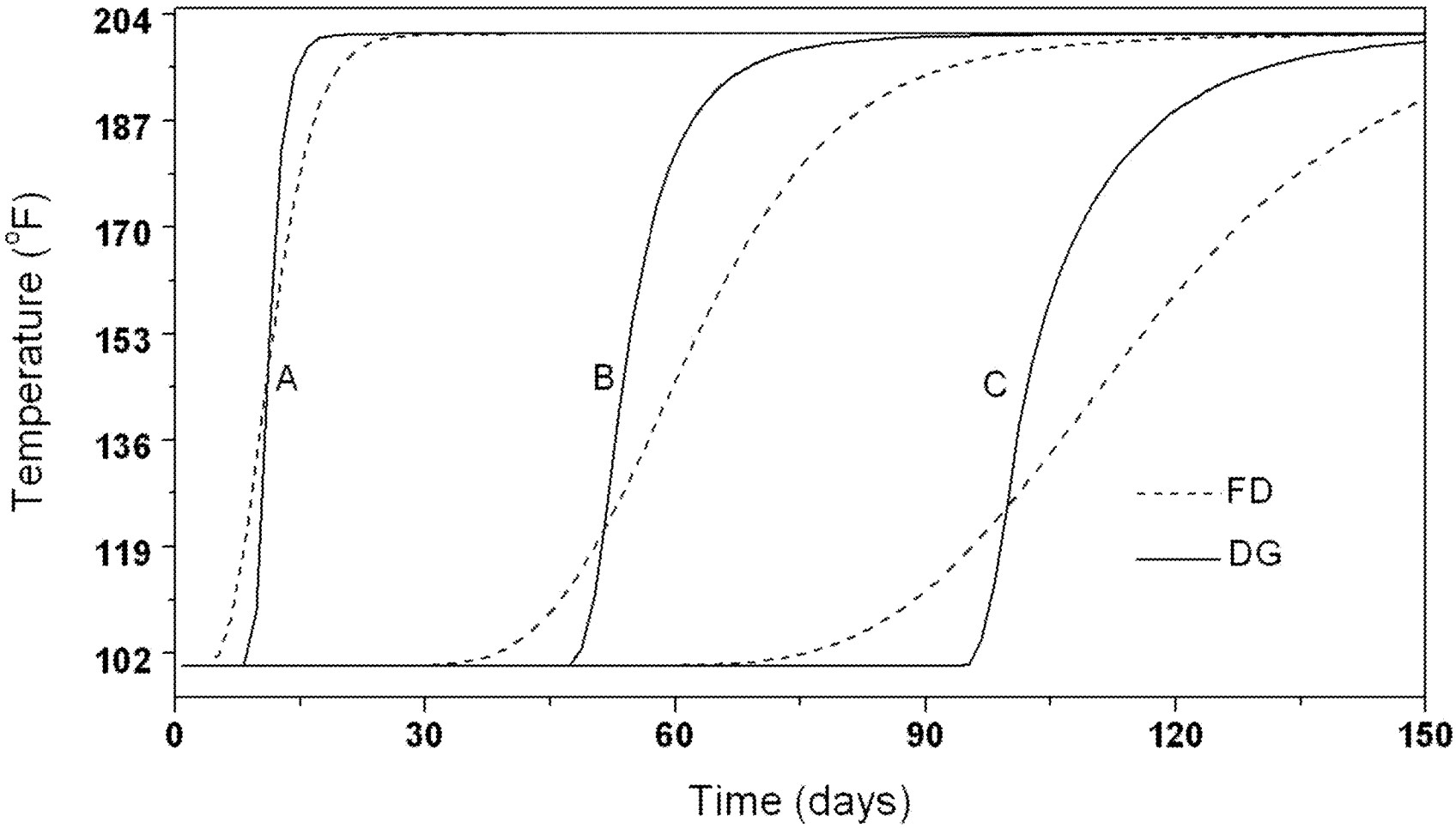
FIG. 14: Solutions of temperature versus time by the DG and FD methods at three locations A, B, and C, as shown in FIG. 13.

The second example represents a 2D cross section of dimensions 500 ft×500 ft. The domain is heterogeneous, where the grid is populated with random permeabilities ranging between 1 mD and 800 mD. Hot fluid is injected at one corner to displace oil to the opposite corner. The temperature solutions by the DG and FD methods are shown in FIGS. 13*a* and 13*b*, respectively, on a 50×50 Cartesian grid. The FD solution is more dispersive than the DG solution near the heat front. FIG. 14 demonstrates the temperature behavior by the FD and DG methods versus time at three locations labeled as, A, B, and C, as shown in FIG. 13*a*. There is a substantial advantage of the DG method compared to the traditional approach. It is expected that the FD method will require orders of magnitude more grid-cells to obtain a comparable accuracy as the DG solution. In 3D space, the advantage of the DG method is expected to be more pronounced.

The DG solution provides many benefits over traditional modeling techniques. Not only does the $\alpha$-slope limiter impose constraints on the interface temperatures to avoid local maxima and minima. The parameter a can take any value in the interval [0, 1] and controls the degree of restriction of the slope limiter. The DG method associated with the $\alpha$-slope limiter guarantees a solution free from non-physical oscillations. The DG method improves the accuracy of the thermal solution near heat front and reduces numerical dispersion. Thus the DG method eliminates the need to have fine gridding and is orders of magnitude faster than the tradition FD method.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. No. 6,152,226, Talwani, et al., "System and process for secondary hydrocarbon recovery" (2000).
2. U.S. Pat. No. 6,718,291, Shapiro, et al., "Mesh-free method and system for modeling and analysis" (2004).
3. U.S. Pat. No. 6,823,297, Jenny, et al., "Multi-scale finite-volume method for use in subsurface flow simulation", (2004).
4. U.S. Pat. No. 6,842,725, Sarda, "Method for remodeling fluid flows in a fractured multilayer porous medium and correlative interactions in a production well" (2005).
5. U.S. Pat. No. 6,922,662, Manceau, et al., "Method for modeling flows in a fractured medium crossed by large fractures", (2002).
6. U.S. Pat. No. 7,006,959, Huh, et al., "Method and system for simulating a hydrocarbon-bearing formation" (2006).
7. U.S. Pat. No. 7,024,342, Waite, et al., "Thermal flow simulation for casting/molding processes", (2006).
8. U.S. Pat. No. 7,027,964, Kennon "Method and system for solving finite element models using multiphase physics", (2002).
9. U.S. Pat. No. 7,249,009, Ferworn, et al., "Method and apparatus for simulating PVT parameters", (2007).
10. US2008208539, Lee, et al., "Method, apparatus and system for reservoir simulation using a multi-scale finite volume method including black oil modeling", (2008).
11. WO0102832, Allouche, "Modelling the rheological behaviour of drilling fluids as a function of pressure and temperature", (2001).
12. WO2007061618, Fedorova, et al., "Simulation System and Method", (2007).
13. WO2008006851, Hiroshi, et al., "Non-volatile phase-change memory and manufacturing method thereof" (2008).
14. Coats "An Equation of State Compositional Model" Society of Petroleum Engineering, October 1980, pp. 363-376 (1980).
15. De Basabe, et al. "Grid Dispersion of the Discontinuous Galerkin Method for Elastic Wave Propagation," SEG Las Vegas 2008 Annual Meeting, (2008).
16. Hoteit, H. "Higher-order methods in reservoir simulation: Luxury or necessity?," SPE Distinguished Lecturer Program, (2007).
17. Naguib, et al. "Optimizing Field Performance Using Reservoir Modeling and Simulation" SPE 70037-MS, SPE Permian Basin Oil and Gas Recovery Conference, 15-17 May 2001, Midland, Tex. (2001).
18. Nakashima, et al. "Development of an equation of state fully implicit compositional model," Sekiyu Gijutsu Kyokaishi, 65:42-351 (2000).
19. Oladyshkin and Panfilov, "Limit thermodynamic model for compositional gas-liquid systems moving in a porous medium," Transport in Porous Media, 70#2 (2007).
20. Swapan, "Diffusion and dispersion in the simulation of vapex process paper," 2005 SPE International Thermal Operations and Heavy Oil Symposium held in Calgary, Alberta, Canada, 1-3 Nov. (2005).

The invention claimed is:

1. A method of dynamic reservoir simulation comprising:

a) partitioning, via a computing processor, a reservoir geometry into one or more grid-blocks in 1D, 2D or 3D space;

b) assigning fluid and rock properties to one or more grid-blocks;

c) assigning boundary conditions and well properties to one or more grid-blocks;

d) solving pressure, material balance, and energy balance equations wherein the pressure equation and material balance equation are solved by finite difference (FD) method and the energy balance equation is solved by discontinuous Galerkin (DG) method to determine temperature of the one or more grid-blocks; and e) simulating fluid flow across one or more grid-blocks by using results from the solved pressure, material balance, and energy balance equations.

2. The method of claim 1, wherein said one or more grid-blocks are selected from the group consisting of: Cartesian, corner-point-geometry, static, dynamic, radial, curvilinear, and any combination thereof.

3. The method of claim 1, wherein the one or more pressure, material balance, or energy balance equations are applied in Implicit Pressure-Explicit Saturation (IMPES), fully implicit models, adaptive implicit model, or any combination thereof.

4. The method of claim 1, wherein said reservoir properties is simulated using a thermal model, steam-flooding model, steam-assisted gravity drainage (SAGD) model, black-oil model, compositional model, finite-difference simulator, or the like.

5. The method of claim 1, wherein average temperature and the temperature differences at the grid-block interface are calculated for each grid.

6. The method of claim 1, wherein 2 degrees of freedom in a 1D model, 3 degrees of freedom in a 2D model, or 4 degrees of freedom in a 3D model.

7. The method of claim 1, wherein $\alpha$-slope limiter is a value between 0 and 1 including 0, 0.1, 0.2, 0.3, 0.4, 0.5, 0.6, 0.7, 0.8, 0.9, and 1.0.

8. A method of dynamic reservoir simulation comprising:

a) partitioning, via a computing processor, a reservoir geometry into one or more grid-blocks in 1D, 2D or 3D space;

b) assigning fluid and rock properties to one or more grid-blocks;

c) assigning boundary conditions and well properties to one or more grid-blocks; i) calculate average temperature at the center of the grid blocks and temperatures at the grid blocks interfaces, ii) apply a slope limiter to improve stability of the analysis, iii) use interface temperatures to calculate thermal fluxes among grid-blocks;

d) solving pressure, material balance, and energy balance equations wherein the pressure equation and material balance equation are solved by finite difference (FD) method and the energy balance equation is solved by discontinuous Galerkin (DG) method to determine temperature of the one or more grid-blocks; and e) simulating fluid flow across one or more grid-blocks by using results from the solved pressure, material balance, and energy balance equations.

9. The method of claim 8, wherein said one or more grid-blocks are selected from the group consisting of: Cartesian, corner-point-geometry, static, dynamic, radial, curvilinear, and any combination thereof.

10. The method of claim 8, wherein one or more of the pressure, material balance, or energy balance equations are applied in Implicit Pressure-Explicit Saturation (IMPES), fully implicit models, adaptive implicit model, or any combination thereof.

11. The method of claim 8, wherein said reservoir properties are simulated using a thermal model, steam-flooding model, steam-assisted gravity drainage (SAGD) model, black-oil model, compositional model, finite-difference simulator, or any combination thereof.

12. The method of claim 8, wherein the average temperature and the temperature differences at the grid-block interface are calculated for each grid.

13. The method of claim 8, wherein 2 degrees of freedom in a 1D model, 3 degrees of freedom in a 2D model, or 4 degrees of freedom in a 3D model.

14. The method of claim 8, wherein the slope limiter is a value between 0 and 1 including 0, 0.1, 0.2, 0.3, 0.4, 0.5, 0.6, 0.7, 0.8, 0.9, and 1.0.

* * * * *